US005768653A

United States Patent [19]

Faré

[11] Patent Number: 5,768,653

[45] Date of Patent: Jun. 16, 1998

[54] ELECTROPHOTOGRAPHIC PRINTING DEVICE WITH A CHARGING ROLLER

[75] Inventor: Carlo Faré, Milan, Italy

[73] Assignee: Compuprint S.p.A., Turin, Italy

[21] Appl. No.: 811,031

[22] Filed: Mar. 4, 1997

[30] Foreign Application Priority Data

Mar. 8, 1996 [EP] European Pat. Off. ..... 96830104

[51] Int. Cl.[6] ..... G03G 15/02

[52] U.S. Cl. ..... 399/50; 399/66; 399/176; 399/313

[58] Field of Search ..... 399/50, 66, 168, 399/174, 176, 297, 310, 313, 314, 318; 361/225

[56] References Cited

U.S. PATENT DOCUMENTS

| | | | |
|---|---|---|---|
| 3,626,260 | 12/1971 | Kimura et al. . | |
| 5,089,851 | 2/1992 | Tanaka et al. | 399/176 |
| 5,119,141 | 6/1992 | Bhagat | 399/66 X |
| 5,144,368 | 9/1992 | Ohzeki et al. | 399/176 |
| 5,321,476 | 6/1994 | Gross | 399/66 |
| 5,412,455 | 5/1995 | Ono et al. | 399/176 |
| 5,446,615 | 8/1995 | Matsumoto et al. | 361/225 |
| 5,495,317 | 2/1996 | Matsuda et al. | 399/66 |
| 5,678,129 | 10/1997 | Yasuda et al. | 399/50 |

FOREIGN PATENT DOCUMENTS 6-222649 8/1994 Japan .

OTHER PUBLICATIONS

Patent Abstracts of Japan, 95 (002) for Publication No.: JP7-049601, Publication Date: Feb. 21, 1995.

*Primary Examiner*—Sandra L. Brase
*Attorney, Agent, or Firm*—Finnegan, Henderson, Farabow, Garrett & Dunner, L.L.P.

[57] ABSTRACT

In an electrophotographic printing device, a charging roller for a photoconductive drum is constituted by an outer, resilient and resistive layer and by a conductive core connected to earth by means of an element with adjustable resistance. The charging roller is rotated and at the same time its outer layer is charged, by an auxiliary conductive roller which is in contact with the charging roller along a generatrix, with a specific surface charge which is discharged gradually through the resistive layer and the adjustable resistor according to a law determined by the value of the adjustable resistor so that the residual charge transferred by the charging roller to the drum can be controlled simply, reliably and repetitively, so as to adopt an optimal value.

10 Claims, 4 Drawing Sheets

ELECTROPHOTOGRAPHIC PRINTING DEVICE WITH A CHARGING ROLLER

BACKGROUND OF THE INVENTION

The present invention relates to an electrophotographic printing device and, in particular, to an electrophotographic printing device with a charging roller.

In electrophotographic printing devices, a photoconductive (or light-sensitive) drum is uniformly charged electrically (positively or negatively) and an image, called the latent image, is then formed thereon by a process of selective exposure to a light source (positive or negative). Particles of powdered pigment or "toner" (charged positively or negatively) are transferred selectively to the photoconductive drum and from there to a printing substrate, generally a sheet of paper, suitably charged electrically (positively or negatively). This technique is used in various electrophotographic printing devices known in the art, such as, for example "laser" printers, printers with rows (arrays) of diodes, and photocopiers. Clearly, it is possible to have various combinations of electrical charge of positive/negative sign for charging the drum, for the toner particles and for the printing substrate, associated, as appropriate, with a positive or negative printing process. In practice, however, the most widespread process is the negative process with the use of toner which is charged negatively by the triboelectric effect. In this case, the photoconductive drum is charged uniformly with a negative charge and is exposed selectively to form a negative image, without charge, onto which the toner is transferred.

The devices usually used for electrically charging the photoconductive drum are constituted by a conductive wire (not in contact with the photoconductive drum) supplied by a suitable voltage source, known as control grid electrostatic dischargers or, in Italian, "scorotrons". These devices have a fairly low charging speed and require a high supply energy; moreover, in the case of the emission of negative electrical charges, they produce ozone which is a harmful substance.

To prevent the problems mentioned above, various contact electrical charging devices have been proposed. One solution is that of using conductive elements such as brushes disposed in contact with the photoconductive surface of the drum; for example, EP-A-0,312,230 describes the use of an electrified blade. This solution has the problem that the contact between the conductive element and the drum is not always uniform so that the transfer of the electric charge onto the photoconductive surface is not uniform; moreover, the parts which are in sliding contact are subject to wear, so that the problem described above is accentuated owing to the wear of the blade and the useful life of the photoconductive drum is reduced.

A different solution is that of using a charging roller pressed along a generatrix of the photoconductive drum. The basic problem of devices with charging rollers is that of applying the correct amount of electric charge to the photosensitive surface of the drum. The surface of the charging roller may be conductive and may be connected to a suitable voltage supply; beneath the conductive surface, there is a resilient, insulating layer which ensures the necessary resilience of the roller. In this case, however, it is difficult to couple a conductive layer with conductivity characteristics which do not change with time to an underlying resilient support.

The charging roller is usually constituted by a conductive, cylindrical core and an outer, resilient layer having a suitable resistivity. The core is connected to a suitable voltage source so that a charging current flows from the conductive core through the resilient layer to the surface of the photoconductive drum; the circuit is closed by the capacitance formed by the photoconductive layer of the drum of which the conductive core is generally connected to earth.

This known solution has some disadvantages. In this device, it is extremely difficult to ensure the optimal accumulation of electric charge on the surface of the drum; a weak current flow in the charging roller causes the formation of a surface charge which is insufficient to transfer (positive process) or to repel (negative process) the toner completely, whereas a high current flow causes the formation of an excessive surface charge. For the electric charge and for the current which generates it there is therefore a critical window within which the charging system is functional.

This critical operative condition is achieved either by calibration of the force with which the charging roller presses against the photoconductive drum, or by the construction of the charging roller of material having sufficient electrical conductivity, consistent with the mechanical situation, to allow the electric charges to be deposited on the drum in the desired quantity.

These requirements make the production of these devices very critical; sophisticated solutions are required for identifying the optimal dimensions of the diameter of the charging roller and of the photoconductive drum, as well as of the ratio between them, to ensure a predetermined contact pressure between the charging roller and drum and to identify the type of composition preferred for the formation of the charging roller.

Moreover, slight eccentricity of the photoconductive drum and/or of the charging roller cause a variation in the contact pressure between the two elements. This variation of the contact pressure generates a variation in the thickness of the outer resilient layer with a consequent variation in its resistivity. The electric charge which is introduced into the conductive core, and flows through the resistance of the resilient layer is thus susceptible to variations in the course of the electrophotographic process.

It should be added that the photoconductive drum and/or the charging roller usually have imperfections along their generatrix of contact so that the contact pressure varies along it; this variation therefore generates a non-uniform distribution of the electric charge on the photoconductive drum. Finally, the known device can be varied or adapted solely at the design stage so that it is not possible to compensate for variations due, for example, to the wear and aging of the materials. These limitations also greatly restrict the characteristics of the charging process and hence the printing, for example, restricting the capability to vary the speed of the printing process in the same device.

SUMMARY OF THE INVENTION

These problems of the prior art are solved by the invention as claimed. The present invention thus provides an electrophotographic printing device comprising a photoconductive drum for the formation of a latent image, a charging roller in contact with pressure with the photoconductive drum along a generatrix of the photoconductive drum, the charging roller having an inner, conductive, cylindrical core and an outer, resilient and resistive layer, characterized in that the core is electrically insulated, and in that the device further comprises an auxiliary conductive roller in pressurised contact with the charging roller along a generatrix of the charging roller in order to apply an electric charge to the outer layer, and resistive means with adjustable resistance connecting the core of the charging roller to earth or to a suitable predetermined reference voltage or more properly electric potential.

In this solution, the surface electric charge applied to the charging roller by the auxiliary conductive roller is partially discharged in a controlled manner and in the opposite direction to that usually used through the series of resistors constituted by the resilient and resistive layer of the charging roller and the adjustment element with variable resistance. The residual charge, which has a controlled intensity, is transferred to the photoconductive drum in the contact nip between the charging roller and the photoconductive drum.

It has been found that, with this arrangement, the electric charge transferred to the drum is largely insensitive to variations of the contact pressure of the charging roller and of the consequent variations in the resistivity of the material and, in practice, depends solely upon the voltage applied and upon the variable adjustment resistance; the electric charge transferred is particularly insensitive to wear and to aging of the materials and to any eccentricity of the photoconductive drum and/or of the charging roller.

The distribution of the electric charge on the drum is uniform and is independent of imperfections of the photoconductive drum and/or of the charging roller along their generatrix of contact.

The solution of the present invention thus enables a predetermined electric charge to be applied to the drum in a repetitive manner, regardless of variations of the contact pressure, and permits compensation within wide limits for the various conductivity characteristics of the charging roller which may result from production processes or from the use of different materials, freeing the charging device from the critical design and production conditions of known devices.

The resistive means with adjustable resistance connected to the core of the charging roller may be formed in various ways, for example, by means of a variable resistor, a field-effect MOS device or a bipolar transistor. In a preferred embodiment, the resistive means with adjustable resistance are constituted by a transistor controlled by a driver circuit.

The adjustable resistance may be calibrated manually on the basis of a knowledge of the characteristics of the charging device, or automatically. The electrophotographic printing device advantageously further comprises a sensor for detecting an indication of the quantity of electric charge transferred to the photoconductive drum and adjustment means connected to the sensor and to the resistive means with adjustable resistance in order to vary the adjustable resistance in dependence on the indication of the quantity of electric charge detected by the sensor.

An expert in the art will appreciate that various embodiments of the sensor are possible; for example, it may be formed by a charge detector placed in the region of the charging roller or in the region of the drum.

The electric charge transferred to the drum may have either a positive or a negative sign, combined in a suitable manner with the sign of the charge of the toner particles and of the transfer device and with the type of printing process; typically, the electric charge is negative.

Problems similar to those described above for the charging device are also displayed by the device for transferring the toner from the photoconductive drum to the printing substrate. Known transfer devices usually include a transfer roller constituted by a conductive, cylindrical core and an outer, resilient layer having a suitable resistivity; this transfer roller is pressed against the photoconductive drum to form a nip through which the printing substrate is passed. The core is connected to a suitable voltage source, so that a charging current flows from the conductive core through the resilient layer to the surface of the printing substrate; the circuit is closed by the series of capacitors formed by the printing substrate and the photoconductive layer of the drum of which the conductive core is connected to earth.

As described above for the charging device, the production of known transfer devices is extremely critical. Moreover, the characteristics of these transfer devices are susceptible to variations in the course of the electrophotographic process and may cause a non-uniform distribution of the electric charge. Finally, the known device cannot compensate for variations due, for example, to wear and aging of the materials and cannot be modified dynamically on the basis of the characteristics of the printing process.

In a preferred embodiment of the present invention, the electrophotographic printing device further comprises a transfer roller which is in contact with pressure with the photoconductive drum along a generatrix of the photoconductive drum in order to transfer to a printing substrate a toner selectively applied to the photoconductive drum in accordance with the latent image, the transfer roller having an inner, conductive, cylindrical core and an outer, resilient and resistive layer, and a further auxiliary conductive roller which is in contact with pressure with the transfer roller along a generatrix of the transfer roller in order to apply an electric charge to the surface of the transfer roller the conductive core of which is electrically insulated and connected to earth by means of further resistive means with adjustable resistance.

As described for the charging device, this solution renders the electric charge transferred to the printing substrate largely insensitive to variations in the contact pressure of the transfer roller and thus, in particular, to wear and aging of the materials, to any eccentricity of the photoconductive drum and/or of the transfer roller and to imperfections thereof.

Moreover, the use of structurally similar charging and transfer devices enables the entire electrophotographic printing device to be simplified and its production cost to be reduced.

The further adjustable resistance can be calibrated manually on the basis of a knowledge of the weight in grams of the type of paper used and of the environmental conditions in which the printing substrates are stored, or automatically. The electrophotographic printing device advantageously comprises a sensor for measuring a parameter which affects a transfer operation carried out by the transfer roller, the adjustment means being connected to the sensor and to the further resistive means with adjustable resistance in order to vary the further adjustable resistance in dependence on the parameter measured by the sensor.

The sensor may be constituted, for example, by a thickness detector; additionally, or alternatively, it may also be able to detect the humidity of the printing substrate with the use of capacitive electrical techniques.

In the solution according to the present invention, the electric charge transferred can easily be controlled and adjusted in dependence on specific requirements and any variable operative conditions of the electrophotographic printing device. In one particular embodiment of the present invention, the electrophotographic printing device further comprises control means for selectively setting a particular peripheral velocity of the photoconductive drum and for varying the adjustable resistance and the further adjustable resistance in dependence on the particular peripheral velocity.

This solution enables the value of the electric charge transferred to be adjusted and controlled easily in dependence on the speed of the printing process; the electrophotographic printing device can thus operate at different speeds, for example, at a low speed to achieve high print resolution and at a high, for example, double speed to achieve a higher productivity (throughput) but with lower resolution.

Finally, a method of electrophotographic printing corresponding to the device described above is provided.

BRIEF DESCRIPTION OF THE DRAWINGS

Various embodiments of the present invention will now be described by way of example, with reference to the appended drawings, in which.

DETAILED DESCRIPTION OF THE INVENTION

For simplicity of description, reference will always be made below to an electrophotographic printing device with a charging device of negative sign, a negative printing process, negatively-charged toner particles and a positively-charged transfer device. The various combinations of electric charges of positive/negative sign for the charging of the drum, of the toner particles and of the printing substrate, associated in an appropriate manner with a positive or negative printing process are clear to an expert in the art.

Figure 1:
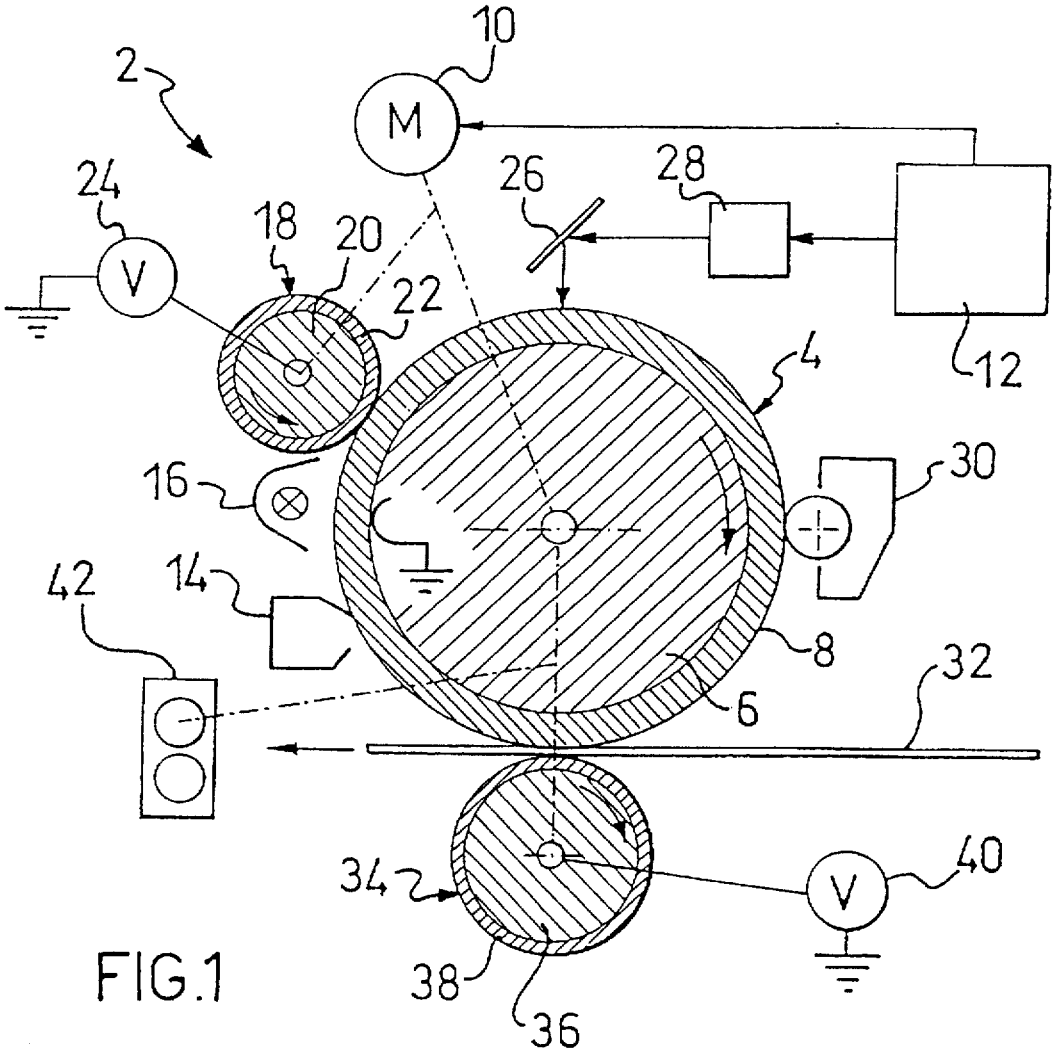
FIG. 1 shows schematically a known electrophotographic printing device.

A known electrophotographic printing device will now be described with reference to the drawings and, in particular, with reference to FIG. 1. The electrophotographic printing device 2 comprises a photoconductive drum 4 constituted by a conductive core 6 (connected to earth) and by an outer photoconductive layer 8. The drum 4 is rotated by a motor 10 which is controlled by a control unit 12 in order to impart to the drum 4 a predetermined peripheral velocity in the sense of rotation indicated by the arrow.

Arranged along generatrices of the photoconductive drum 4 in known manner and in order, with reference to the sense of rotation of the photoconductive drum 4, are a cleaning device with a cleaning blade 14, followed by a lamp 16 for neutralizing residual electric charges and normalizing the photoconductive layer 8.

These are followed by a conventional device for electrically charging the photoconductive layer, comprising a charging roller 18 constituted by an inner, conductive core 20 and by an outer resilient and resistive layer 22 pressed against a generatrix of the photoconductive drum 4. The conductive core 20 is supplied by a suitable negative voltage source 24.

The printing device 2 then comprises a scanning device 26 and a selective exposure device 28 (generally a laser diode) controlled by the unit 12, followed by a developing device 30 for selectively applying the toner to the light-sensitive surface 8 of the drum.

Finally, there is a device for transferring the toner selectively deposited on the surface 8 of the photoconductive drum onto a printing substrate 32, the device comprising a transfer roller 34 constituted by a conductive core 36 and by an outer resilient and resistive layer 38 pressed against the photoconductive drum 4 to form a nip through which the printing substrate 32 is passed. The conductive core 36 of the transfer roller is supplied by a positive voltage supply 40. This transfer device charges the opposite face of the printing substrate 32 to that which is contact with the photoconductive drum 4 and with the toner with an electric charge of the opposite sign to that of the toner which is therefore attracted onto the printing substrate 32.

The printing substrate 32 is advanced at a controlled speed equal to the peripheral velocity of the photoconductive drum 4 to a fixing station 42.

All of these aspects are conventional and well known and do not require further explanation.

Figure 2:
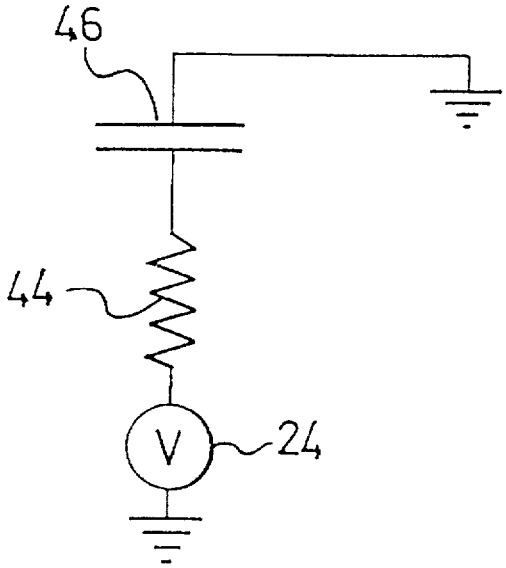
FIG. 2 shows the electrical circuit equivalent to the known charging device and used in the device of FIG. 1.

The circuit equivalent to the structure of the device for electrically charging the photoconductive layer is shown as a first approximation by the circuit of FIG. 2; as can be seen, the generator 24 is connected to a resistor 44 and a capacitor 46 in series.

The resistor 44 represents the resistance of a limited cylindrical arc of the resistive layer 22 disposed beside the photoconductive drum 4, and the capacitor 46 represents the capacitance formed by a limited cylindrical arc of the conductive core 6 of the photoconductive drum and the juxtaposed cylindrical arc of the conductive core 20 of the charging roller, separated by a dielectric constituted by the photoconductive layer 8 of the drum.

Clearly, the time constant RC of the circuit is variable in dependence on the resistance 44.

Since the rotation of the drum 4 and of the charging roller 18 continuously renews the elements of the circuit, the capacitor 46 is charged, during the short and finite transit time in which the two elements are juxtaposed, to a voltage level which depends upon the time constant RC of the circuit and is variable with R.

Unfortunately, it is precisely this arc of the resistive layer 22 of the charging roller which is subject to variations in resistivity due to variations in compression and the charge state of the capacitor 46 is thus, to a large extent, more unpredictable the greater is the time constant RC.

The variability of the charge state can be limited to a certain extent by the formation of the resistive layer of materials of low resistivity but this requirement is difficult to achieve.

Figure 3:
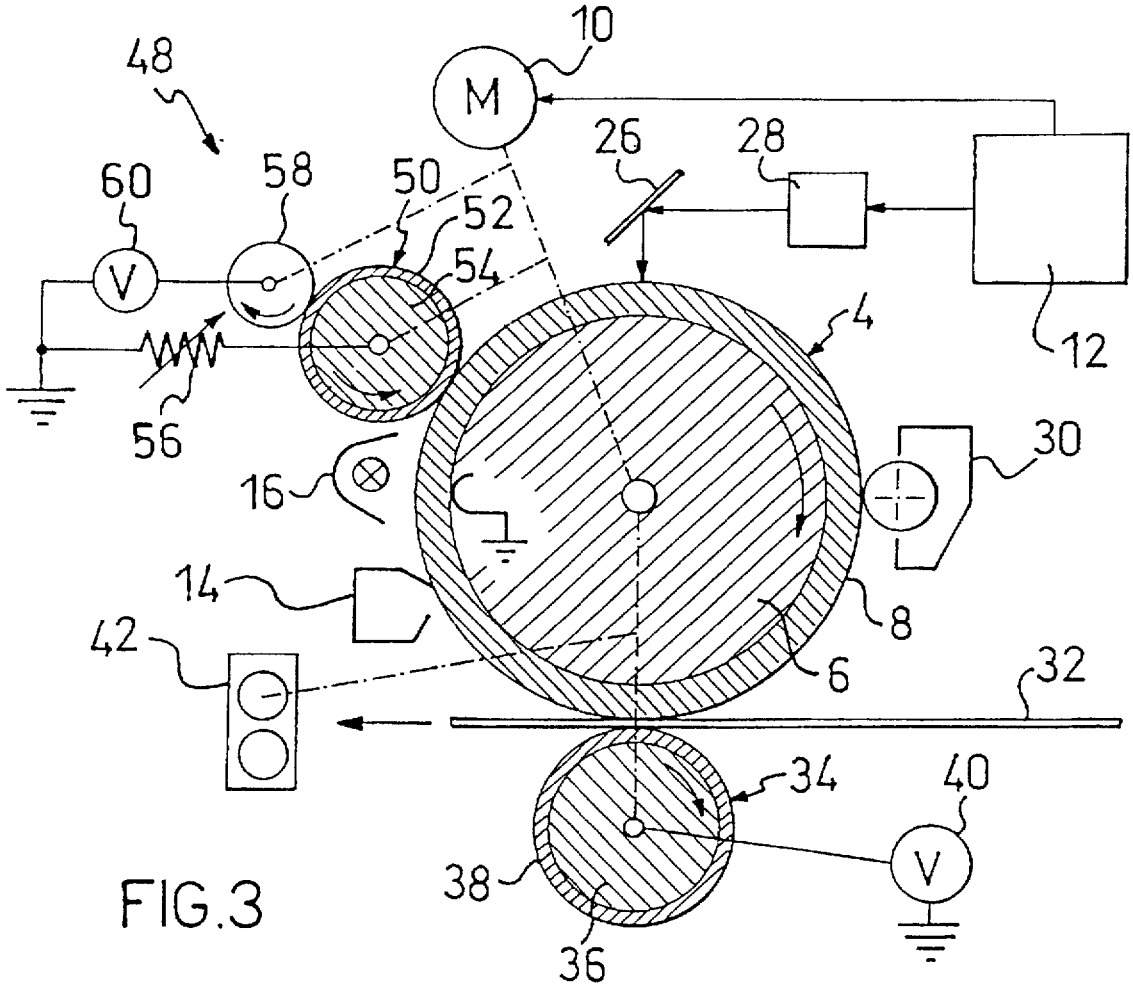
FIG. 3 shows schematically an embodiment of the electrophotographic printing device according to the present invention.

With reference now to FIG. 3, this shows schematically an embodiment of the electrophotographic printing device according to the present invention.

With the exception of the charging device, all of the other elements present in the electrophotographic printing device 48 are conventional and have already been explained with reference to FIG. 1 and they are therefore identified by the same reference numerals.

The charging device comprises a charging roller 50 constituted by a resilient, outer layer 52 and by a conductive core 54 supported for rotation by bearings electrically insulating it from earth; typically, the outer layer 52 has a high resistance of the order of $10^8$ Ω or more. The charging roller 50 is placed in contact with pressure with the outer surface 8 of the photoconductive drum along a generatrix thereof.

The conductive core 54 is connected to earth, or to a predetermined reference voltage which may be different from ground voltage, by means of an element 56 with adjustable resistance; this element 56 is constituted, for example, by a variable resistor, a field-effect MOS device, or a bipolar transistor.

The charging device comprises an auxiliary conductive roller 58 supported for rotation by bearings insulating it electrically from earth and is placed in contact with pressure with the charging roller 50 along a generatrix thereof; the auxiliary conductive roller 58 is supplied by a source 60 of a negative voltage of suitable value; typical values for the voltage are, for example, from −1 kV to −2 kV relative to an earth reference.

The generatrix of contact between the auxiliary conductive roller 58 and the charging roller 50 enables the outer surface 52 to be charged with an electric charge having a predetermined intensity.

Both the charging roller 50 and the conductive roller 58 are rotated by the motor 10 with peripheral velocities coordinated with (substantially equal to) the peripheral velocity of the photoconductive drum 4. Alternatively, one or more of these rollers may be rotated by entrainment; for example, the auxiliary conductive roller 58 may be entrained by the charging roller 50, by virtue of the contact friction.

The auxiliary conductive roller 58 applies to each surface element of the charging roller 50 a specific charge Qs which, as a first approximation, ignoring the effect of the resistance of the resilient layer and of the variable resistance 56, depends solely upon the voltage applied to the auxiliary conductive roller 58 by the voltage generator 60.

The angular velocity of rotation of the charging roller 50 multiplied by the angle of rotation necessary to bring the electric charge to the generatrix of contact with the surface 8 of the photoconductive drum defines the delay with which the electric charge is transferred.

Figure 4:
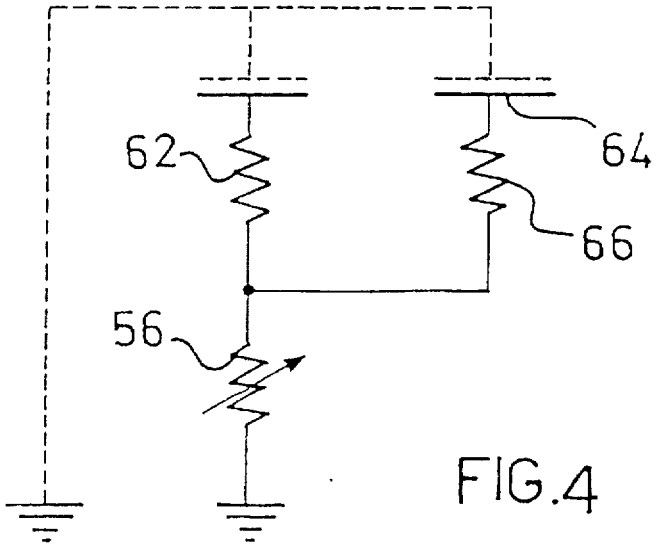
FIG. 4 shows the electrical circuit equivalent to the charging device used in the device of FIG. 3.

The electric circuit equivalent to the charging device described above is shown as a first approximation in FIG. 4.

The charge Qs is discharged gradually, by an exponential law, though the resistance 62 of the resilient and resistive layer 52 of the charging roller and the variable resistor 56 which connects the core 54 of the charging roller to earth, these resistors being arranged in series.

Naturally, in parallel with the surface element of the charging roller and the resistor 62, there is a plurality of other surface elements with respective resistances, shown schematically by the element 64 and by the resistor 66, each being charged with the same specific charge at different times.

A suitable selection of the resistivity of the resilient layer 52 of the charging roller, which has to be high and is therefore easy to reconcile with the requirement for resilience of materials such as synthetic rubbers, and of the value of the adjustable resistance 56, enables the residual specific charge transported by the charging roller 50 to the region of contact with the drum 4 to have the optimal desired value; this value is usually of the order of −700 V.

The mere combination of the auxiliary conductive roller 58 and of the adjustable resistor 56 thus enables a predetermined electric charge to be applied to the drum 4 in a repetitive manner regardless of variations in the contact pressure.

It also permits compensation within wide limits for the various conductivity characteristics of the charging roller which may result from wear, from aging of the materials, from the production processes, or from the use of different materials, freeing the charging device from the critical design and production conditions of known devices.

The adjustable resistance 56 may be calibrated manually on the basis of a knowledge of the characteristics of the charging device (material, thickness, pressure, etc.).

Figure 5:
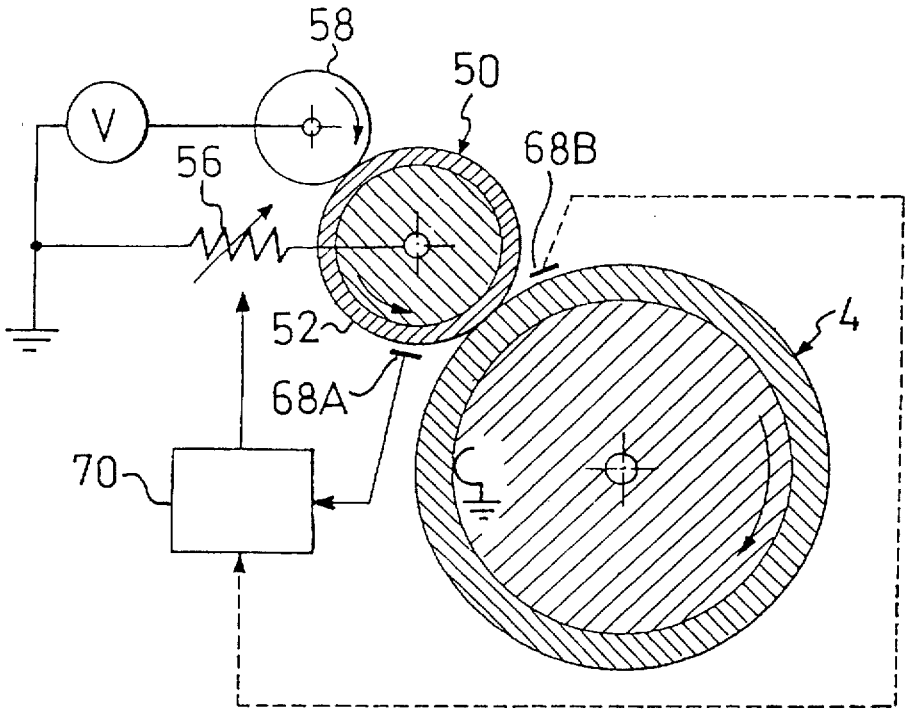
FIG. 5 shows schematically a different embodiment of the charging device with automatic control of the variable resistance.

Alternatively, the resistance 56 may be regulated automatically. As shown in FIG. 5, the charging device includes an electric charge detector with a sensor 68A, preferably disposed in the region of the charging roller 50 beyond the generatrix of contact with the auxiliary conductive roller 58 (with reference to the sense of rotation indicated by the arrow) and a little before the generatrix of contact with the drum 4. This sensor 68A can detect the quantity of electric charge present on the outer surface 52 of the charging roller using known electrical techniques. Clearly, the sensor may be placed in various other positions, for example, in the region of the drum 4 a little after the generatrix of contact with the charging roller 50 (with reference to the sense of rotation indicated by the arrow) as shown in FIG. 5 by the variant shown by a broken line and identified by the numeral 68B.

The value of the electric charge thus detected is transferred to an adjustment unit 70 which sends a suitable adjustment command to the variable resistor 56.

Figure 6:
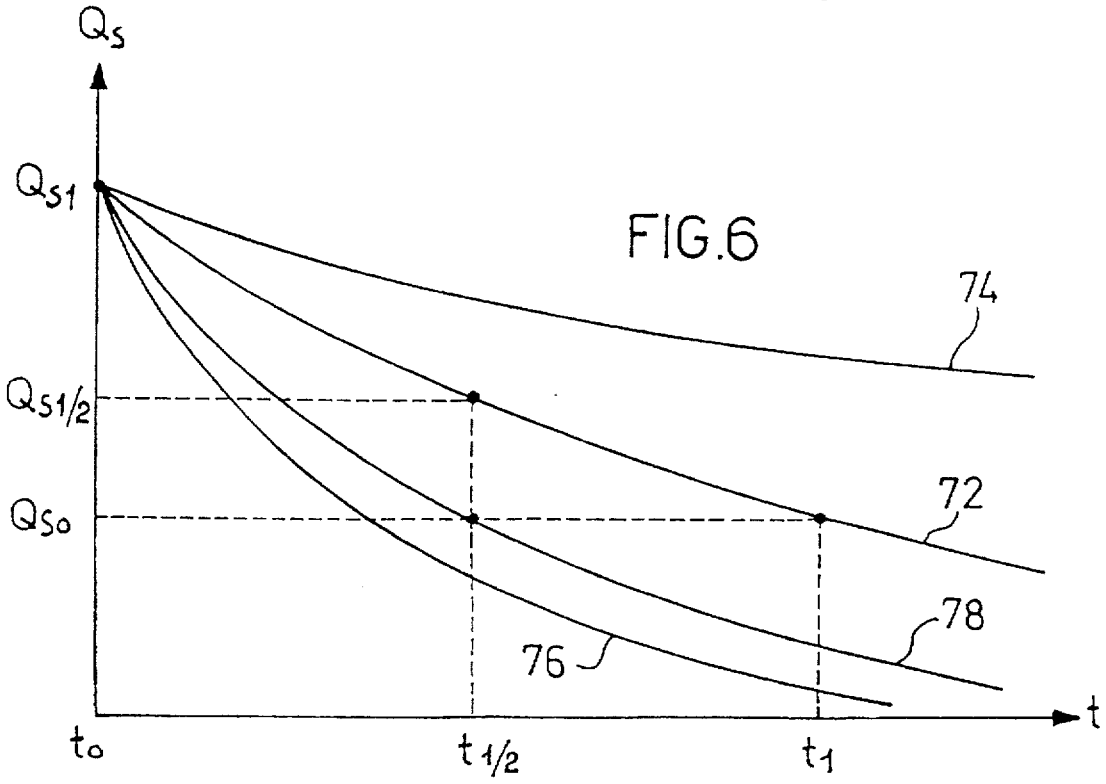
FIG. 6 shows the variation of the specific surface charge on the surface of the charging roller, in a qualitative time graph.

FIG. 6 is a qualitative time graph of the variation of the specific surface charge Qs.

The initial value Qs1 depends, as stated, on the supply voltage of the conductive roller and also, to a certain extent, on the resistivity of the resilient layer and on the value of the variable resistance.

The specific charge Qs decays over time, starting from the initial value Qs1, by an exponential law defined by the time constant of the discharge circuit (FIG. 4) and represented by the graph 72.

If the value of the variable resistance 56 (FIG. 4) is increased, the time constant increases so that the initial specific charge Qs1 decays according to the graph 74 (as a first approximation, the value of the initial charge Qs1 may be considered equal).

If the value of the variable resistance 56 is reduced, the time constant decreases and the initial specific charge Qs1 decays according to the graph 76.

If t1−t0 represents the transit time of the surface element from the point of contact with the conductive roller to that of contact with the drum, the variable resistance 56 can easily be calibrated so that the specific charge on the photoconductive surface of the drum has a value Qs0 which is optimal for the development process (the selective transfer of the toner from the developer roller to the surface of the photoconductive drum).

Clearly, during the time interval t1−t0, the resilient and resistive layer of the charging roller is not subjected to resilient deformations and its resistivity therefore does not change and does not cause any uncertainty in the value of Qs0.

The value of Qs on the drum can easily be adjusted and controlled in dependence on the process parameters and also, in particular, in dependence on the speed of the printing process.

For example, if the speed of the printing process is doubled, this involves an increase in the residual specific charge Qs½ transferred to the photoconductive drum at the time t½.

However, by reducing the value of the resistor 56, and consequently the time constant of the discharge circuit, it is possible to arrange (graph 78) for the residual specific charge still to have the value Qs0 at the time t1/2.

It is thus extremely easy to produce electrophotographic printing devices which can operate at different speeds, for example, at a low speed to achieve a high print resolution and at a high, for example, double speed, to achieve a higher productivity (throughput) but with lower resolution.

A transfer device according to a particular embodiment of the present invention is now described with reference to FIG. 7.

The transfer device is similar to the charging device described above. It comprises a transfer roller 80 in contact with pressure with the outer surface 8 of the photoconductive drum along a generatrix thereof; this transfer roller 80 is constituted by a resilient outer layer 82 and by a conductive core 84 supported for rotation by bearings electrically insulating it from earth.

The conductive core 84 is connected to earth (or to a predetermined reference voltage) by means of an element 86 with adjustable resistance.

The transfer device comprises a further auxiliary conductive roller 88 in contact with pressure with the transfer roller along a generatrix thereof; the auxiliary conductive roller 88 is supported for rotation by bearings electrically insulating it from earth and is supplied by a source 90 of a positive voltage of suitable value.

The generatrix of contact between the auxiliary conductive roller 88 and the transfer roller 80 enables the outer surface 82 to be charged with an electric charge having a predetermined intensity.

The operation of this transfer device is exactly the same as that of the charging device described above.

Figure 7:
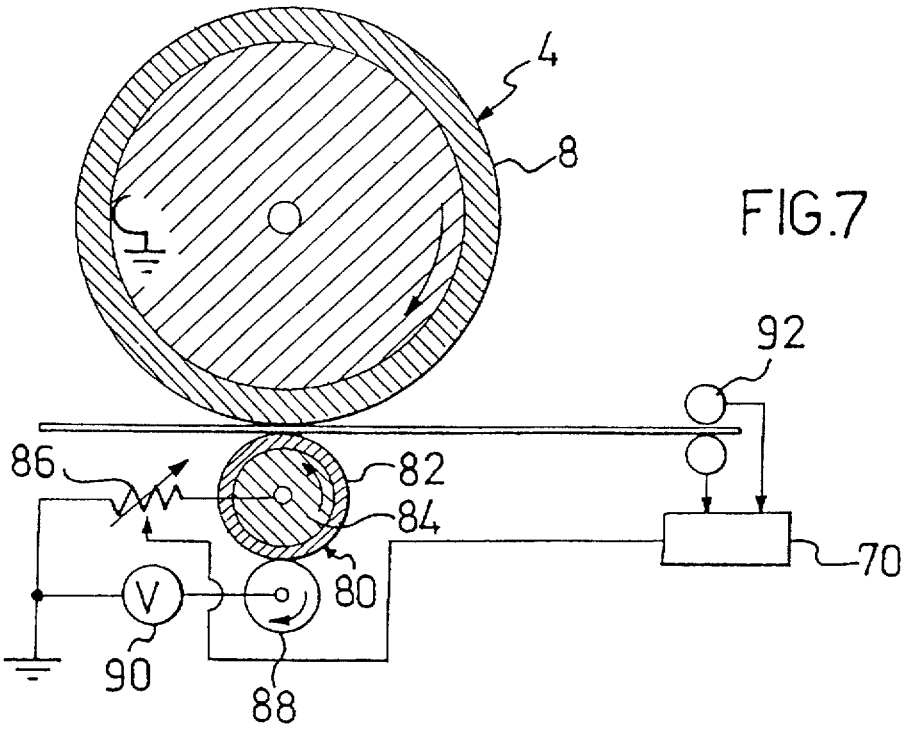
FIG. 7 shows schematically a transfer device according to an embodiment of the present invention.

In the embodiment shown in FIG. 7, the adjustable resistance 86 is calibrated automatically. As shown, upstream of the transfer station constituted by the nip formed by the light-sensitive drum 4 and the transfer roller 80, there is a thickness detector 92 which can also detect the humidity of the printing substrate with the use of known capacitive electrical techniques and can send a suitable adjustment command to the variable resistor 86 by means of the adjustment unit 70 (described with reference to FIG. 5). In an alternative embodiment, two different adjustment units may be used, one for controlling the variable resistance 56 (FIG. 5) and another for controlling the variable resistance 86.

Clearly, the automatic adjustment of the resistance 86 may be replaced by a manual calibration based on a knowledge of the components of the type of paper used and the environmental conditions in which the printing substrates are stored.

Figure 8:
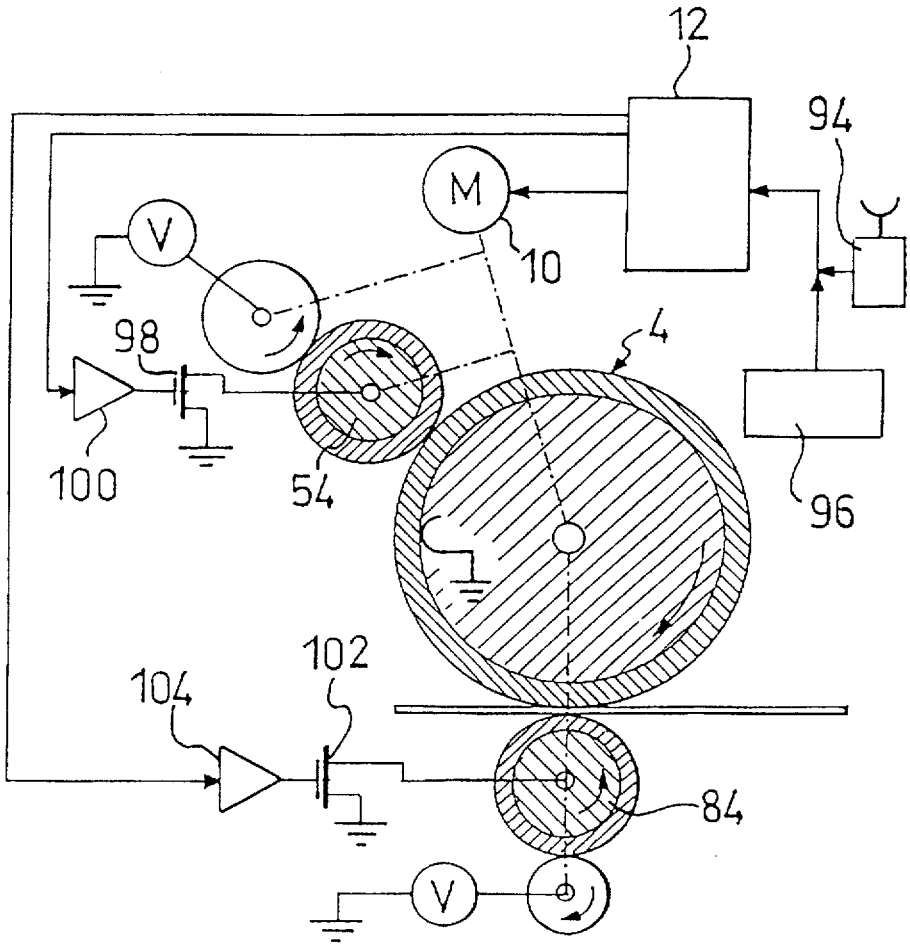
FIG. 8 shows schematically a different embodiment of the electrophotographic device for permitting different printing speeds.

FIG. 8 shows schematically an electrophotographic device which can operate at different printing speeds.

The control unit 12 receives, from a bistable control key 94 or from a system processor 96 such as a PC, a selection signal for a high-speed or low-speed operative mode and, in dependence on this signal, controls the speed of rotation of the motor 10 driving the movable parts of the device (the photoconductive drum, the charging roller, the conductive roller, the transfer roller, the fixing station, etc.).

It also controls the two variable resistor described above which, in the embodiment of FIG. 8, are constituted by two electronic devices; in particular, the variable resistor of the charging device is constituted by a metal oxide semiconductor field-effect transistor (MOSFET) 98 controlled by a driver circuit 100 and the resistor of the transfer device is constituted by a further MOSFET 102 controlled by a further driver circuit 104. The two MOSFETS 98 and 102 constitute resistors which are variable in a controlled manner and which connect the conductive core 54 of the charging roller and the conductive core 84 of the transfer roller, respectively, to earth.

What I claim is:

1. An electrophotographic printing device comprising:

a photoconductive drum for the formation of a latent image, a charging roller in contact with and pressure with the photoconductive drum along a generatrix of the photoconductive drum, the charging roller having an inner, conductive, cylindrical core and an outer, resilient and resistive layer, said core being electrically insulated, an auxiliary conductive roller in contact with and pressure with the charging roller along a generatrix of the charging roller in order to apply an electric charge to said outer layer, and resistive means with adjustable resistance connecting said core to a predetermined reference electric potential.

2. An electrophotographic printing device according to claim 1, in which the resistive means with adjustable resistance are constituted by a transistor controlled by a driver circuit.

3. An electrophotographic printing device according to claim 1, further comprising:

a sensor for detecting an indication of the quantity of electric charge transferred to the photoconductive drum, and adjustment means connected to the sensor and to the resistive means with adjustable resistance in order to vary the adjustable resistance in dependence on the indication of the quantity of electric charge detected by the sensor.

4. An electrophotographic printing device according to claim 3, further comprising a transfer roller which is in contact with pressure with the photoconductive drum along a generatrix of the photoconductive drum in order to transfer to a printing substrate a toner selectively applied to the photoconductive drum in accordance with the latent image, the transfer roller having an inner, conductive, cylindrical core and an outer, resilient and resistive layer, and a further auxiliary conductive roller which is in contact with pressure with the transfer roller along a generatrix of the transfer roller in order to apply an electric charge to the outer layer of said tranfer roller, the core of said transfer roller being electrically insulated and connected to a predetermined reference electric potential by further resistive means with adjustable resistance.

5. An electrophotographic printing device according to claim 4, comprising:

a further sensor for measuring a parameter which affects a transfer operation carried out by the transfer roller, the adjustment means being connected to the further sensor and to the further resistive means with adjustable resistance in order to vary the adjustable resistance of said further resistive means in dependence on the parameter measured by the further sensor.

6. An electrophotographic printing device according to claim 1, in which the electric charge is negative.

7. An electrophotographic printing device according to claim 1, further comprising a transfer roller which is in contact with pressure with the photoconductive drum along a generatrix of the photoconductive drum in order to transfer to a printing substrate a toner selectively applied to the photoconductive drum in accordance with the latent image, the transfer roller having an inner, conductive, cylindrical core and an outer, resilient and resistive layer, and a further auxiliary conductive roller which is in contact with pressure with the transfer roller along a generatrix of the transfer roller in order to apply an electric charge to the outer layer of said tranfer roller, the core of said transfer roller being electrically insulated and connected to a predetermined reference electric potential by further resistive means with adjustable resistance.

8. An electrophotographic printing device according to claim 5, further comprising control means for selectively setting a particular peripheral velocity of the photoconductive drum and for varying the adjustable resistance of said resistive means and said further resistive means in dependence on the particular peripheral velocity.

9. A method of electrophotographic printing comprising the steps of:

electrically charging the surface of a photoconductive drum in a uniform manner by means of a charging roller in contact with and pressure with the photoconductive drum along a generatrix of the photoconductive drum, the charging roller having an inner, conductive, cylindrical core and an outer resilient and resistive layer, forming a latent image by selective exposure of the surface of the photoconductive drum, and selectively applying a toner to the surface of the photoconductive drum in accordance with the latent image, where:

the electrical charging step includes the step of rotating the charging roller and at the same time applying an electric charge to the outer layer along generatrices of the charging roller by means of an auxiliary conductive roller which is in contact with and pressure with the charging roller along a generatrix of the charging roller, the core being electrically insulated and connected to a reference electric potential by resistive means with adjustable resistance.

10. The electrophotographic printing method of claim 9, further comprising the step of:

transferring the toner from the surface of the photoconductive drum to a printing substrate by means of a transfer roller which is in contact with pressure with the photoconductive drum along a generatrix of the photoconductive drum, the transfer roller having an inner, conductive cylindrical core and an outer, resilient and resistive layer, the transfer step including the step of rotating the transfer roller and at the same time applying an electric charge to the outer layer of said transfer roller along a generatrix of the transfer roller by means of a further auxiliary conductive roller which is in contact with pressure with the transfer roller along a generatrix of the transfer roller, whose core is electrically insulated and connected to a reference electric potential by means of further resistive means with adjustable resistance.

* * * * *